US011339636B2

(12) United States Patent
Arsalan et al.

(10) Patent No.: US 11,339,636 B2
(45) Date of Patent: May 24, 2022

(54) DETERMINING THE INTEGRITY OF AN ISOLATED ZONE IN A WELLBORE

(71) Applicants: Saudi Arabian Oil Company, Dhahran (SA); WIRELESS INSTRUMENTATION SYSTEMS AS, Trondheim (NO)

(72) Inventors: Muhammad Arsalan, Dhahran (SA); Jarl André Fellinghaug, Trondheim (NO); Stian Marius Hansen, Trondheim (NO); Vegard Fiksdal, Trondheim (NO)

(73) Assignees: Saudi Arabian Oil Company, Dhahran (SA); Wireless Instrumentation Systems AS, Trondheim (NO)

( * ) Notice: Subject to any disclaimer, the term of this patent is extended or adjusted under 35 U.S.C. 154(b) by 16 days.

(21) Appl. No.: 16/866,060

(22) Filed: May 4, 2020

(65) Prior Publication Data

US 2021/0340849 A1 Nov. 4, 2021

(51) Int. Cl.
*E21B 43/14* (2006.01)
*E21B 33/12* (2006.01)
(Continued)

(52) U.S. Cl.
CPC ..... *E21B 43/14* (2013.01); *E21B 33/1208* (2013.01); *E21B 47/06* (2013.01); *E21B 47/008* (2020.05)

(58) Field of Classification Search
CPC .... E21B 43/14; E21B 33/1208; E21B 33/124; E21B 47/06; E21B 47/008
See application file for complete search history.

(56) References Cited

U.S. PATENT DOCUMENTS 2,643,723 A 6/1953 Lynes
2,959,225 A * 11/1960 Roberts ..... E21B 33/1243 166/147
(Continued)

FOREIGN PATENT DOCUMENTS

CN 101592475 12/2009
CN 201496028 6/2010
(Continued)

OTHER PUBLICATIONS

Bao et al., "Recent development in the distributed fiber optic acoustic and ultrasonic detection," Journal of Lightwave Technology vol. 35, No. 16, Aug. 15, 2017, 12 pages.
(Continued)

*Primary Examiner* — George S Gray
(74) *Attorney, Agent, or Firm* — Fish & Richardson P.C.

(57) ABSTRACT

A zonal isolation assessment system includes a receiver, production tubing disposed in a wellbore, a zonal isolation assembly, and an assessment assembly. The zonal isolation assembly is fluidically coupled to the production tubing. The zonal isolation assembly includes isolation tubing that flows production fluid from the wellbore to the production tubing, a first sealing element, and a second sealing element to fluidically isolate an internal volume of the isolation tubing from an isolated annulus defined between the isolation tubing and the wall of the wellbore. The assessment assembly includes a first pressure sensor at the internal volume of the isolation tubing configured to sense a first pressure value and a second pressure sensor at the annulus and configured to sense a second pressure value. The assessment assembly transmits to the receiver the first pressure value and the second pressure value to determine the integrity of the zonal isolation assembly.

20 Claims, 3 Drawing Sheets

(51) Int. Cl.
*E21B 47/06* (2012.01)
*E21B 47/008* (2012.01)

(56) References Cited

U.S. PATENT DOCUMENTS

| | | | |
|---|---|---|---|
| 3,175,618 | A | 3/1965 | Lang et al. |
| 3,448,305 | A | 6/1969 | Raynal et al. |
| 3,558,936 | A | 1/1971 | Horan |
| 3,663,845 | A | 5/1972 | Apstein |
| 3,918,520 | A | 11/1975 | Hutchison |
| 3,970,877 | A | 7/1976 | Russell et al. |
| 4,387,318 | A | 6/1983 | Kolm et al. |
| 4,536,674 | A | 8/1985 | Schmidt |
| 4,685,523 | A | 8/1987 | Paschal, Jr. et al. |
| 5,113,379 | A | 5/1992 | Scherbatskoy |
| 5,150,619 | A | 9/1992 | Turner |
| 5,224,182 | A | 6/1993 | Murphy et al. |
| 5,301,760 | A | 4/1994 | Graham |
| 5,317,223 | A | 5/1994 | Kiesewetter et al. |
| 5,350,018 | A | 9/1994 | Sorem et al. |
| 5,375,622 | A | 12/1994 | Houston |
| 5,613,555 | A | 3/1997 | Sorem et al. |
| 5,708,500 | A | 1/1998 | Anderson |
| 5,892,860 | A | 4/1999 | Maron et al. |
| 5,965,964 | A | 10/1999 | Skinner et al. |
| 6,044,906 | A | 4/2000 | Saltel |
| 6,068,015 | A | 5/2000 | Pringle |
| 6,082,455 | A | 7/2000 | Pringle et al. |
| 6,193,079 | B1 | 2/2001 | Weimer |
| 6,209,652 | B1 | 4/2001 | Portman et al. |
| 6,504,258 | B2 | 1/2003 | Schultz et al. |
| 6,578,638 | B2 | 6/2003 | Guillory et al. |
| 6,588,266 | B2 | 7/2003 | Tubel et al. |
| 6,728,165 | B1 | 4/2004 | Roscigno et al. |
| 6,768,214 | B2 | 7/2004 | Schultz et al. |
| 6,779,601 | B2 | 8/2004 | Wilson |
| 6,913,079 | B2 | 7/2005 | Tubel |
| 6,920,085 | B2 | 7/2005 | Finke et al. |
| 7,199,480 | B2 | 4/2007 | Fripp et al. |
| 7,224,077 | B2 | 5/2007 | Allen |
| 7,242,103 | B2 | 7/2007 | Tips |
| 7,249,805 | B2 | 7/2007 | Cap |
| 7,345,372 | B2 | 3/2008 | Roberts et al. |
| 7,410,003 | B2 | 8/2008 | Ravensbergen et al. |
| 7,668,411 | B2 | 2/2010 | Davies et al. |
| 7,847,421 | B2 | 12/2010 | Gardner et al. |
| 7,906,861 | B2 | 3/2011 | Guerrero et al. |
| 7,946,341 | B2 | 5/2011 | Hartog et al. |
| 8,047,232 | B2 | 11/2011 | Bernitsas |
| 8,258,644 | B2 | 9/2012 | Kaplan |
| 8,408,064 | B2 | 4/2013 | Hartog et al. |
| 8,421,251 | B2 | 4/2013 | Pabon et al. |
| 8,426,988 | B2 | 4/2013 | Hay |
| 8,493,556 | B2 | 7/2013 | Li et al. |
| 8,564,179 | B2 | 10/2013 | Ochoa et al. |
| 8,604,634 | B2 | 12/2013 | Pabon et al. |
| 8,638,002 | B2 | 1/2014 | Lu |
| 8,648,480 | B1 | 2/2014 | Liu et al. |
| 8,786,113 | B2 | 7/2014 | Tinnen et al. |
| 8,916,983 | B2 | 12/2014 | Marya et al. |
| 8,925,649 | B1 | 1/2015 | Wiebe et al. |
| 8,948,550 | B2 | 2/2015 | Li et al. |
| 9,091,144 | B2 | 7/2015 | Swanson et al. |
| 9,106,159 | B1 | 8/2015 | Wiebe et al. |
| 9,130,161 | B2 | 9/2015 | Nair et al. |
| 9,140,815 | B2 | 9/2015 | Lopez et al. |
| 9,170,149 | B2 | 10/2015 | Hartog et al. |
| 9,239,043 | B1 | 1/2016 | Zeas |
| 9,321,222 | B2 | 4/2016 | Childers et al. |
| 9,322,389 | B2 | 4/2016 | Tosi |
| 9,499,460 | B2 | 11/2016 | Kawamura et al. |
| 9,581,489 | B2 | 2/2017 | Skinner |
| 9,599,460 | B2 | 3/2017 | Wang et al. |
| 9,599,505 | B2 | 3/2017 | Lagakos et al. |
| 9,617,847 | B2 | 4/2017 | Jaaskelainen et al. |
| 9,784,077 | B2 | 10/2017 | Gorrara |
| 10,115,942 | B2 | 10/2018 | Qiao et al. |
| 10,209,383 | B2 | 2/2019 | Barfoot et al. |
| 10,367,434 | B2 | 7/2019 | Ahmad |
| 2002/0043404 | A1 | 4/2002 | Trueman et al. |
| 2006/0086498 | A1 | 4/2006 | Wetzel et al. |
| 2007/0012437 | A1 | 1/2007 | Clingman et al. |
| 2007/0181304 | A1 | 8/2007 | Rankin et al. |
| 2008/0048455 | A1 | 2/2008 | Carney |
| 2008/0100828 | A1 | 5/2008 | Cyr et al. |
| 2008/0277941 | A1 | 11/2008 | Bowles |
| 2009/0166045 | A1 | 7/2009 | Wetzel et al. |
| 2010/0164231 | A1 | 7/2010 | Tsou |
| 2010/0308592 | A1 | 12/2010 | Frayne |
| 2011/0049901 | A1 | 3/2011 | Tinnen |
| 2011/0088462 | A1 | 4/2011 | Samson et al. |
| 2011/0273032 | A1 | 11/2011 | Lu |
| 2012/0018143 | A1 | 1/2012 | Lembcke |
| 2012/0211245 | A1 | 8/2012 | Fuhst et al. |
| 2012/0292915 | A1 | 11/2012 | Moon |
| 2013/0068481 | A1 | 3/2013 | Zhou |
| 2013/0091942 | A1 | 4/2013 | Samson et al. |
| 2013/0119669 | A1 | 5/2013 | Murphree |
| 2013/0167628 | A1 | 7/2013 | Hull et al. |
| 2013/0200628 | A1 | 8/2013 | Kane |
| 2013/0227940 | A1 | 9/2013 | Greenblatt |
| 2014/0167418 | A1 | 6/2014 | Hiejima |
| 2014/0175800 | A1 | 6/2014 | Thorp |
| 2014/0284937 | A1 | 9/2014 | Dudley et al. |
| 2014/0311737 | A1 | 10/2014 | Bedouet et al. |
| 2015/0114127 | A1 | 4/2015 | Barfoot et al. |
| 2015/0318920 | A1 | 11/2015 | Johnston |
| 2016/0168957 | A1 | 6/2016 | Tubel |
| 2016/0177659 | A1 | 6/2016 | Voll et al. |
| 2016/0273947 | A1 | 9/2016 | Mu et al. |
| 2017/0033713 | A1 | 2/2017 | Petroni |
| 2017/0075029 | A1 | 3/2017 | Cuny et al. |
| 2017/0235006 | A1 | 8/2017 | Ellmauthaler et al. |
| 2017/0260846 | A1 | 9/2017 | Jin et al. |
| 2018/0045543 | A1 | 2/2018 | Farhadiroushan et al. |
| 2018/0052041 | A1 | 2/2018 | Yaman et al. |
| 2018/0155991 | A1* | 6/2018 | Arsalan ..... E21B 34/06 |
| 2018/0156030 | A1* | 6/2018 | Arsalan ..... E21B 33/1277 |
| 2018/0209253 | A1* | 7/2018 | Westberg ..... F04D 25/022 |
| 2018/0274311 | A1 | 9/2018 | Zsolt |
| 2018/0351480 | A1 | 12/2018 | Ahmad |
| 2019/0025095 | A1 | 1/2019 | Steel |
| 2019/0049054 | A1 | 2/2019 | Gunnarsson |
| 2019/0128113 | A1 | 5/2019 | Ross et al. |
| 2019/0253003 | A1 | 8/2019 | Ahmad |
| 2019/0253004 | A1 | 8/2019 | Ahmad |
| 2019/0253005 | A1 | 8/2019 | Ahmad |
| 2019/0253006 | A1 | 8/2019 | Ahmad |
| 2019/0376371 | A1 | 12/2019 | Arsalan |
| 2021/0156244 | A1* | 5/2021 | Hoeie ..... E21B 47/117 |

FOREIGN PATENT DOCUMENTS

| | | |
|---|---|---|
| CN | 102471701 | 5/2012 |
| CN | 101488805 | 8/2012 |
| CN | 103913186 | 7/2014 |
| CN | 105043586 | 11/2015 |
| CN | 107144339 | 9/2017 |
| CN | 206496768 | 9/2017 |
| CN | 105371943 | 6/2018 |
| CN | 108534910 | 9/2018 |
| DE | 202012103729 | 10/2012 |
| EP | 0380148 | 8/1990 |
| EP | 1041244 | 10/2000 |
| GB | 2218721 | 11/1989 |
| JP | 2010156172 | 7/2010 |
| WO | WO9306331 | 4/1993 |
| WO | WO 2009024545 | 2/2009 |
| WO | WO2009046709 | 4/2009 |
| WO | WO2014116458 | 7/2014 |
| WO | WO2015073018 | 5/2015 |
| WO | WO2016111849 | 7/2016 |
| WO | WO2016130620 | 8/2016 |
| WO | WO2017146593 | 8/2017 |

(56) References Cited

FOREIGN PATENT DOCUMENTS

| | | | |
|---|---|---|---|
| WO | WO2018125071 | 7/2018 | |
| WO | WO2018145215 | 8/2018 | |
| WO | WO 2018160347 | 9/2018 | |
| WO | WO-2018160347 A1 * | 9/2018 | ..... E21B 47/07 |

OTHER PUBLICATIONS

Bybee et al., "Through-Tubing Completions Maximize Production," Drilling and Cementing Technology, JPT, Feb. 2006, SPE-0206-0057, 2 pages.
Chen et al., "Distributed acoustic sensor based on two-mode fiber," Optics Express, Sep. 2018, 9 pages.
Cox et al., "Realistic Assessment of Proppant Pack Conductivity for Material Section," SPE-84506-MS, presented at the Annual Technical Conference, Oct. 5-8, 2003, Society of Petroleum Engineers, 12 pages.
Fornarelli et al., "Flow patterns and heat transfer around six in-line circular cylinders at low Reynolds number," JP Journal of Heat and Mass Transfer, Pushpa Publishing House, Allahabad, India, Feb. 2015, vol. 11, No. 1; pp. 1-28.
Gillard et al., "A New Approach to Generating Fracture Conductivity," SPE-135034-MS, presented at the SPE Annual Technical Conference and Exhibition, Sep. 19-22, 2010, Society of Petroleum Engineers 14 pages.
Gomaa et al., "Computational Fluid Dynamics Applied To Investigate Development and Optimization of Highly Conductive Channels within the Fracture Geometry," SPE-179143-MS, Society of Petroleum Engineers, SPE Production & Operations, 32, 04, Nov. 2017, 12 pages.
Gomaa et al., "Improving Fracture Conductivity by Developing and Optimizing a Channels Within the Fracture Geometry: CFD Study," SPE-178982-MS, Society of Petroleum Engineers, SPE International Conference and Exhibition on Formation Damage Control, Feb. 24-26, 2016, 25 pages.
Govardhan et al., "Critical mass in vortex-induced vibration of a cylinder," European Journal of Mechanics B/Fluids, Jan.-Feb. 2004, vol. 23, No. 1; pp. 17-27.
International Search Report and Written Opinion in International Appln. No. PCT/US2020/015347, dated May 8, 2020, 13 pages.
International Search Report and Written Opinion issued in International Application No. PCT/US2018/033855 dated Oct. 18, 2018, 14 pages.
International Search Report and Written Opinion issued in International Application No. PCT/US2019/046271 dated Dec. 19, 2019, 15 pages.
Juarez and Taylor, "Field test of a distributed fiber-optic intrusion sensor system for long perimeters," Applied Optics vol. 46, No. 11, Apr. 10, 2007, 4 pages.
Keiser, "Optical fiber communications," p. 26-57, McGraw Hill, 2008, 16 pages.
Kern et al., "Propping Fractures With Aluminum Particles," SPE-1573-G-PA, Journal of Per. Technology, vol. 13, No. 6, Jun. 1961, pp. 583-589, 7 pages.
Meyer et al., "Theoretical Foundation and Design Formulae for Channel and Pillar Type Propped Fractures—A Method to Increase Fracture Conductivity," SPE-170781-MS, Society Of Petroleum Engineers, SPE Annual Technical Conference and Exhibition, Oct. 27-29, 2014, 25 pages.
Palisch et al., "Determining Realistic Fracture Conductivity and Understanding its Impact on Well Performance—Theory and Field Examples," SPE-106301-MS, Society of Petroleum Engineers, SPE Hydraulic Fracturing Technology Conference, Jan. 29-31, 2007, 13 pages.
PCT International Search Report and Written Opinion in International Appln. No. PCT/US2019/061130, dated Mar. 2, 2020, 15 pages.
PCT International Search Report and Written Opinion in International Appln. No. PCT/US2019046272, dated Oct. 14, 2019, 16 pages.
Poollen et al., "Hydraulic Fracturing—FractureFlow Capacity vs Well Producity," SPE-890-G, presented at 32nd Annual Fall Meeting of Society of Petroleum Engineers, Oct. 6-9, 1957, published as Petroleum Transactions AIME vol. 213, 1958, 5 pages.
Poollen, "Productivity vs Permeability Damage in Hydraulically Produced Fractures," Paper 906-2-G, American Petroleum Institute, presented at Drilling and Production Practice, Jan. 1, 1957, 8 pages.
Qin et al., "Signal-to-Noise Ratio Enhancement Based on Empirical Mode Decomposition in Phase-Sensitive Optical Time Domain Reflectometry Systems," Sensors, MDPI, vol. 17, Aug. 14, 2017, 10 pages.
Tinsley and Williams, "A new method for providing increased fracture conductivity and improving stimulation results," SPE-4676-PA, Journal of Petroleum Technology, vol. 27, No. 11, Nov. 1975, 7 pages.
Vincent, "Examining Our Assumptions—Have Oversimplifications Jeopardizedour Ability To Design Optimal Fracture Treatments," SPE119143-MS, presented at the SPE Hydraulic Fracturing Technology Conference, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Vysloukh, "Chapter 8: Stimulated Raman Scattering," p. 298-302, in Nonlinear Fiber Optics, 1990, 5 pages.
Walker et al., "Proppants, We Still Don't Need No Proppants—A Perspective of Several Operators," SPE-38611-MS, presented at the SPE Annual Technical Conference and Exhibition, Sep. 27-30, 1995, 8 pages.
Wang et al., "Rayleigh scattering in few-mode optical fibers," Scientific reports, vol. 6, Oct. 2016, 8 pages.
Williams, "A new method for providing increased fracture conductivitv and improving stimulation results," SPE-4676-PA, Journal of Petroleum Technology, vol. 27, No. 11, MO 1975, (1319-1325).
Yamate et al., "Optical sensors for the exploration of oil and gas," Journal of Lightwave Technology vol. 35, No. 16, Aug. 15, 2017, 8 pages.
PCT International Search Report and Written Opinion in International Appln. No. PCT/US2021/030428, dated Aug. 10, 2021, 14 pages.

* cited by examiner

DETERMINING THE INTEGRITY OF AN ISOLATED ZONE IN A WELLBORE

FIELD OF THE DISCLOSURE

This disclosure relates to wellbore tools, in particular to wellbore monitoring tools.

BACKGROUND OF THE DISCLOSURE

Isolating a zone in a wellbore helps prevent fluids such as water or gas in one zone from mixing with the production fluid in another zone. Zonal isolation includes a hydraulic barrier between an isolated annulus and the production fluid flowing through the production tubing. Isolating a zone can be done as a thru-tubing operation and can be permanent or semi-retrievable. Over the life of the wellbore, as the annular seal is subject to formation and pressure changes, significant pressure and temperature differentials can affect zonal isolation.

SUMMARY

Implementations of the present disclosure include a zonal isolation assessment system that includes a receiver, production tubing, a zonal isolation assembly, and an assessment assembly. The receiver resides at or near a surface of a wellbore. The production tubing is disposed in the wellbore. The zonal isolation assembly resides downhole of and is fluidically coupled to the production tubing. The zonal isolation assembly isolates a zone of the wellbore and includes isolation tubing that flows production fluid from the wellbore to the production tubing, a first sealing element coupled to the isolation tubing, and a second sealing element coupled to the isolation tubing and disposed downhole of the first sealing element. The first sealing element and the second sealing element are set on a wall of the wellbore to fluidically isolate an internal volume of the isolation tubing from an isolated annulus defined between the isolation tubing and the wall of the wellbore. The annulus extends from the first sealing element to the second sealing element. The assessment assembly is disposed at least partially inside the isolation tubing and communicatively coupled to the receiver. The assessment assembly includes a first pressure sensor residing at the internal volume of the isolation tubing and configured to sense a first pressure value representing a fluidic pressure of the internal volume. The assessment assembly also includes a second pressure sensor residing at the annulus and configured to sense a second pressure value representing a fluidic pressure of the annulus. The assessment assembly transmits, to the receiver, the first pressure value and the second pressure value such that the first and second pressure values are usable to determine, based comparing the first pressure value with the second pressure value, a zonal isolation integrity of the zonal isolation assembly.

In some implementations, the first pressure value includes a first set of pressure values sensed by the first pressure sensor over time before and during production, and the second pressure value includes a second set of pressure values sensed by the second pressure sensor over time before and during production. The first set of pressure values and the second set of pressure values are usable to determine the zonal isolation integrity of the zonal isolation assembly by at least one of: 1) comparing a rate of change over time of the second set of pressure values to a first threshold, the second set of pressure values starting at a point in time in which the first set of pressure values represent the beginning of a drawdown pressure, or 2) comparing a rate of change over time between the first set of pressure values and the second set of pressure values to a second threshold. In some implementations, the first threshold represents a percentage of the drawdown pressure. The drawdown pressure represents a change in pressure at the internal volume as the wellbore enters a flowing condition. In some implementations, the first threshold represent 5% or less of the drawdown pressure, and the first and second pressure values are usable to determine low isolation integrity when the rate of change over time of the second set of pressure values is equal to or larger than the threshold.

In some implementations, the assessment assembly continuously or generally continuously transmits real-time data to the receiver. The real-time data represents a first set of pressure values sensed by the first pressure sensor over time before and during production and a second set of pressure values sensed by the second pressure sensor over time before and during production. The first and second set of pressure values are usable to determine the zonal isolation integrity in or near real-time.

In some implementations, the zonal isolation assembly is configured to be permanently set on the wall of the wellbore to isolate the zone of the wellbore during production.

In some implementations, the isolation tubing is disposed at an open hole section of the wellbore. The isolated zone includes a region of the open hole section isolated by the first sealing element and the second sealing element set on a wall of the open hole section of the wellbore.

In some implementations, the receiver is communicatively coupled to a processor configured to determine, based on a rate of change of the first pressure value and the second pressure value, a third value representing a leakage percentage. The processor is configured to determine a level of isolation integrity based on comparing the leakage percentage to a leakage percentage threshold.

In some implementations, the assessment assembly is releasably coupled to and disposed inside the isolation tubing. The assessment assembly includes a fluid pathway configured to receive production fluid from the isolation tubing at the internal volume and flow the production fluid to the first pressure sensor disposed along the fluid pathway.

In some implementations, the assessment assembly can be retrieved from the assessment assembly by a retrieving tool run on wireline, slick line, or coiled tubing.

In some implementations, the assessment assembly includes a first housing that houses and protects circuitry and a battery system that powers electric components of the circuitry. The circuitry receives the first pressure value and the second pressure value and transmits the first pressure value and the second pressure value to the receiver.

In some implementations, the assessment assembly includes a second housing that houses and protects at least a portion of an electric turbine assembly and a pressure compensator. The electric turbine assembly includes a turbine axially coupled to a rotating shaft and configured to rotate under fluidic pressure of production fluid flowing through the turbine. The rotating shaft coupled to an electric generator configured to produce electricity through rotation of the shaft. The electric generator is electrically coupled to and configured to charge batteries of the battery system.

In some implementations, the assessment assembly includes a turbine housing and an engagement assembly releasably attached to the isolation tubing. The first housing and the second housing form a tubular body attached to and disposed between the turbine housing and the engagement assembly. The tubular body forming an annulus with a wall of the isolation tubing in which at least a portion of the fluid pathway is defined.

Implementations of the present disclosure include an assessment assembly that includes isolation tubing disposed in a wellbore downhole of production tubing. The isolation tubing flows production fluid from the wellbore to the production tubing. The assessment assembly also includes a first sealing element coupled to the isolation tubing and a second sealing element coupled to the isolation tubing and disposed downhole of the first sealing element. The first sealing element and the second sealing element is configured to be set on a wall of the wellbore to fluidically isolate an internal volume of the isolation tubing from an isolated annulus defined between the isolation tubing and the wall of the wellbore, the isolated annulus extends from the first sealing element to the second sealing element. The assessment assembly includes a first pressure sensor residing at the internal volume of the isolation tubing, the first pressure sensor communicatively coupled and configured to transmit first pressure information to a receiver at or near a surface of the wellbore. The assessment assembly includes a second pressure sensor residing at the annulus. The second pressure sensor is communicatively coupled and configured to transmit second pressure information to the receiver such that the first pressure information and the second pressure information is usable to determine a zonal isolation integrity of the isolation tubing.

In some implementations, the first pressure sensor and the second pressure sensor are coupled to an autonomous assessment assembly releasably coupled to the isolation tubing. The autonomous assessment assembly includes an energy harvesting system configured to harvest energy from the production fluid to power electronics electrically coupled to the first and second pressure sensor.

In some implementations, the assessment assembly is configured to continuously or generally continuously transmit real-time data to the receiver. The real-time data represents a first set of pressure values sensed by the first pressure sensor over time before and during production and a second set of pressure values sensed by the second pressure sensor over time before and during production. The first and second set of pressure values are usable to determine the zonal isolation integrity.

In some implementations, the isolation tubing is permanently set on the wall of the wellbore to permanently isolate a zone of the wellbore during production. In some implementations, the isolation tubing is disposed at an open hole section of the wellbore. The isolated annulus includes a region of the open hole section and is isolated by the first sealing element and the second sealing element set on a wall of the open hole section of the wellbore.

Implementations of the present disclosure include a method that includes receiving, by a receiver at or near a surface of a wellbore, a first pressure value and a second pressure value from a zonal isolation assembly disposed downhole of production tubing. The zonal isolation assembly includes 1) isolation tubing, 2) a first sealing element coupled to the isolation tubing, 3) a second sealing element coupled to the isolation tubing and disposed downhole of the first sealing element, the first sealing element and the second sealing element configured to be set on a wall of the wellbore to fluidically isolate an internal volume of the isolation tubing from an isolated annulus defined between the isolation tubing and the wall of the wellbore, 4) a first pressure sensor residing at the internal volume of the isolation tubing and configured to sense the first pressure value, and 5) a second pressure sensor residing at the annulus and configured to sense the second pressure value. The method also includes determining, based on comparing the first pressure value to the second pressure value, a third value representing a zonal isolation integrity of the zonal isolation assembly.

In some implementations, receiving the first value includes receiving a first set of pressure values sensed by the first pressure sensor over time before and during production, and receiving the second value includes receiving a second set of pressure values sensed by the second pressure sensor over time before and during production. Determining the third value includes determining the third value based on 1) comparing a rate of change over time of the second set of pressure values to a first threshold, the second set of pressure values starting at a point in time in which the first set of pressure values represent the beginning of a drawdown pressure, or 2) comparing a rate of change over time between the first set of pressure values and the second set of pressure values to a second threshold.

DETAILED DESCRIPTION OF THE DISCLOSURE

The present disclosure describes an autonomous assessment tool fluidically coupled to production tubing and communicatively coupled to a receiver at the surface of the wellbore. The assessment tool or assembly is disposed at an isolated zone to receive hydrocarbons from an isolation assembly containing the assessment assembly. The assessment assembly has an energy harvesting system that uses the production fluid to power the components of the assessment assembly. The assessment assembly has a first pressure sensor disposed inside the assessment assembly and a second pressure sensor disposed outside the isolation assembly, at an isolated annulus. After shut-in, upon entering a flowing condition, production fluid enters the assessment assembly to flow past the first pressure sensor. The first pressure sensor continually senses the pressure of the fluid flowing through the assessment assembly. The second pressure sensor continually senses the pressure in the annulus of the isolated zone. The assessment tool transmits the pressure values to the receiver. The receiver computes a difference between the two pressures and determines, based on the difference between pressures, the integrity of the isolated zone. If pressure in the annulus dropped during drawdown, there is pressure communication between the annulus of the isolated zone and the production tubing, which thereby reduces the integrity of the isolated zone.

Particular implementations of the subject matter described in this specification can be implemented so as to realize one or more of the following advantages. For example, the assessment assembly helps determine in real-time that the isolation integrity of a wellbore zone is successfully deployed in open hole, monitor the integrity of the zonal isolation over time, and monitor the isolated pressure in the isolated zone. Additionally, the assessment tool can help detect early the water front's progressing, which can help in production strategy planning.

Figure 1:
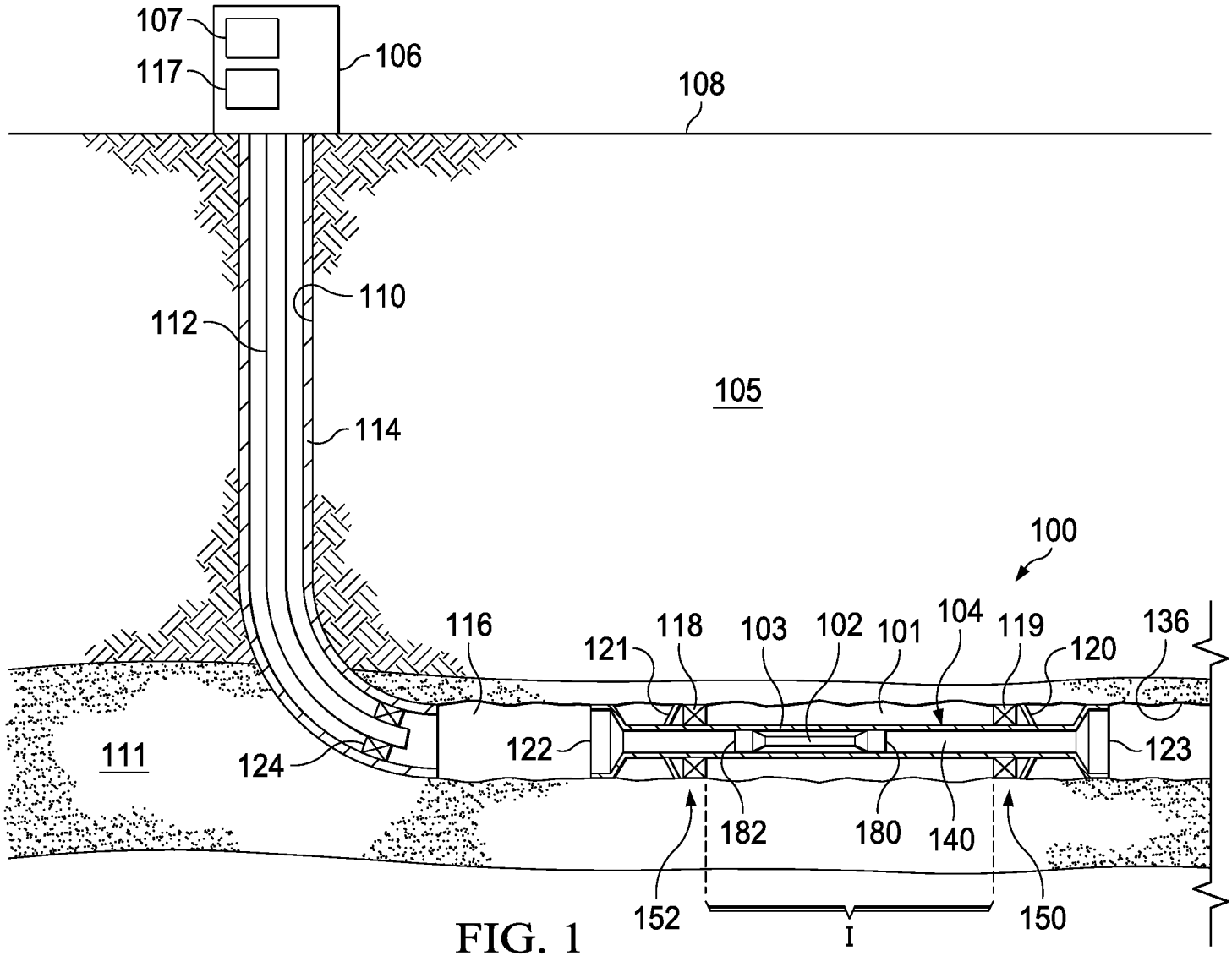
FIG. 1 is a side schematic view of a zonal isolation assessment system implemented in a non-vertical wellbore.

FIG. 1 shows a zonal isolation assessment system 100 disposed inside a wellbore 110. The zonal isolation assessment system 100 is a wellbore assembly for isolating and assessing the integrity of a zone in a production well. The wellbore 110 is formed in a geologic formation 105 that includes a reservoir 111 from which production fluid (for example, hydrocarbons) can be extracted. The wellbore 110 can be a non-vertical wellbore, with a vertical portion and a non-vertical portion (for example, a horizontal portion). The wellbore 110 can include a cased section or portion 114 and an open hole section or portion 116, from which production fluid is extracted.

The assessment system 100 includes a receiver 106, production tubing 112, a zonal isolation assembly 104, and an assessment assembly 102. The receiver resides at or near a surface 108 of the wellbore 110 (for example, at or near a wellhead of the wellbore). The receiver can be communicatively coupled to the assessment assembly 102 through a wireless connection. In some implementations, the pressure data can be stored in a local memory of the assessment assembly 102 and later retrieved with the assessment assembly 102 for analysis.

The production tubing 112 or production string is disposed inside the wellbore 110 and flows production fluid from a downhole location of the wellbore 110 to the surface 108. For example, during production, the production tubing 112 flows hydrocarbons received through the zonal isolation assembly 104 from an upstream location of the open hole section 116 of the wellbore 110 to the surface 108. The production tubing 112 can include an electric submersible pump (not shown) that moves the production fluid from the reservoir 111, through the zonal isolation assembly 104, to the production tubing 112.

The zonal isolation assembly 104 resides downhole of and is fluidically coupled to the production tubing 112. The zonal isolation assembly 104 can be attached to the production tubing 112 or can reside in the open hole section 116 of the wellbore 110 separated from the production tubing 112. The zonal isolation assembly 104 is used for annular zonal isolation of a section of the wellbore. Specifically, the zonal isolation assembly 104 isolates a zone 'I' of the wellbore 110 during production. For example, the zonal isolation assembly 104 can be permanently deployed to a downhole location of the open hole section 116 of the wellbore 110 to permanently isolate the zone 'I' or section of the wellbore, and enable production fluid flowing through the zonal isolation assembly 104 from an upstream location of the open hole section 116 of the wellbore 110.

In another example, the zonal isolation assembly 104 can be semi-permanently deployed to a downhole location of the open hole section 116 of the wellbore 110 to isolate the zone 'I' or section of the wellbore, and enable production fluid flowing through the zonal isolation assembly 104 from an upstream location of the open hole section 116 of the wellbore 110. Parts of he semi retrievable or semi-permanent zonal isolation assembly 104 can be retrieved to the surface 108 (for example, for maintenance), leaving parts of the zonal isolation assembly 104 which facilitate larger ID, leaving a generally unrestricted flow path in the wellbore 110.

One or more isolated zones 'I' can be used for compartmentalizing the wellbore 110 in different zones. While shown in isolated portions of wellbores 110 completed with open hole producing sections 116, the system can be used in cased-hole applications. The isolated zone 'I' can be a zone that contains undesirable fluids or production fluid that is designated for later production.

Specifically, the zonal isolation assembly 104 includes isolation tubing 103, a first sealing element 118 coupled to the isolation tubing 103, and a second sealing element 119 coupled to the isolation tubing 103 downhole of the first sealing element 118. The isolation tubing 103 includes a fluid inlet 123 that receives the production fluid (for example, from the hydrocarbon reservoir 111) and a fluid outlet 122 that flows fluid from the isolation tubing 103 to the production tubing 112. Each sealing element 118 and 119 can be a rubber ring that is part of a respective packer 150 and 152. The packers 150 and 152 include respective anchors 120 and 121 or slips that anchor the zonal isolation assembly 104 to the wellbore 110. The first sealing element 118 and the second sealing element 119 are set on a wall 136 of the wellbore 110 to fluidically isolate an internal volume 140 of the isolation tubing from an isolated annulus 101 defined between the isolation tubing 103 and the wall 136 of the wellbore 110. The annulus 101 extends from the first sealing element 118 to the second sealing element 19 and is fluidically isolated from the rest of the wellbore 110. Thus, the isolated zone 'I' can be a region isolated by the first sealing element 118 and the second sealing element 119 set on the wall 136 of the open hole section 116 of the wellbore 110.

The assessment assembly 102 is disposed at least partially inside the isolation tubing 103 of the isolation assembly 104. As further described in detail later with respect to FIG. 2, the assessment assembly 102 transmits to the receiver 106 information sensed or gathered by pressure sensors coupled to the assessment assembly 102.

The assessment assembly 102 can be releasably coupled to the isolation tubing 103. For example, if the assessment assembly 102 needs to be retrieved, a retrieving tool can retrieve the assessment assembly 102 from the isolation tubing 103 and back to the surface 108. The assessment assembly 102 is fluidically coupled to the isolation tubing 103 to flow production fluid from an inlet 180 of the assessment assembly 102 to an outlet 182 of the assessment assembly 102.

The assessment assembly 102 gathers pressure information before and during production of hydrocarbons to determine zonal isolation integrity of the isolated zone 'I'. Specifically, the assessment assembly 102 compares a fluidic pressure sensed at the internal volume 140 of the isolation tubing 103 to a fluidic pressure sensed at the isolated annulus 101 to determine if there is pressure interference between the annulus 101 and the interior volume 140 of the isolation tubing 103. If there is pressure communication between the two, then the isolated region 'I' has low or no isolation integrity and the sealing elements 118 have to be readjusted (or serviced or replaced) to form an isolated zone with zonal isolation integrity. If it is determined that the zone "I" is compromised, the zone "I" can be extended to cover a larger portion or zone.

As shown in FIG. 1, the receiver 106 can be communicatively coupled to a processor 107 that determines, based on the difference between the pressure at the annulus 101 and the pressure at the internal volume 140, a third value representing a level of zonal isolation integrity. For example, the third value can be a leak rate measured in cubic centimeters per minute (cc/min) or barrels per day. The third value can also be a leakage percentage. For example, the leakage percentage can be calculated using the following equation:

$$\text{Leakage } \% = \frac{\Delta P_2}{\Delta P_1} 100$$

in which $\Delta P_1$ is the change in pressure sensed at the internal volume 140 and $\Delta P_2$ is the change in pressure sensed at the annulus 101. Thus, if $\Delta P_2$ is zero, the leak percentage is 0%, and if $\Delta P_2 = \Delta P_1$, the leak percentage is 100%.

In some implementations, the leak rate or leakage percentage can be used to predict other parameters such as water production rate or time of failure of the zonal isolation assembly 104. The lake rate or percentage can directly affect the water production rate and have negative consequences for the oil production rate. Predictions can be made based on trends, such as sudden increments of the leak rate (or percentage), and based on assumptions to the failure mode, (e.g., assumptions as to where is the water leaking from). As further described in detail later with respect to FIG. 3, the processor can compute a difference between a rate of change over time of the pressure values sensed by the pressure sensors, and use that result to determine the zonal isolation integrity. The receiver 106 can also include a transmitter 117 that transmits instructions to the zonal isolation assembly 104 to increase or decrease the sample rate and resolution.

Figure 2:
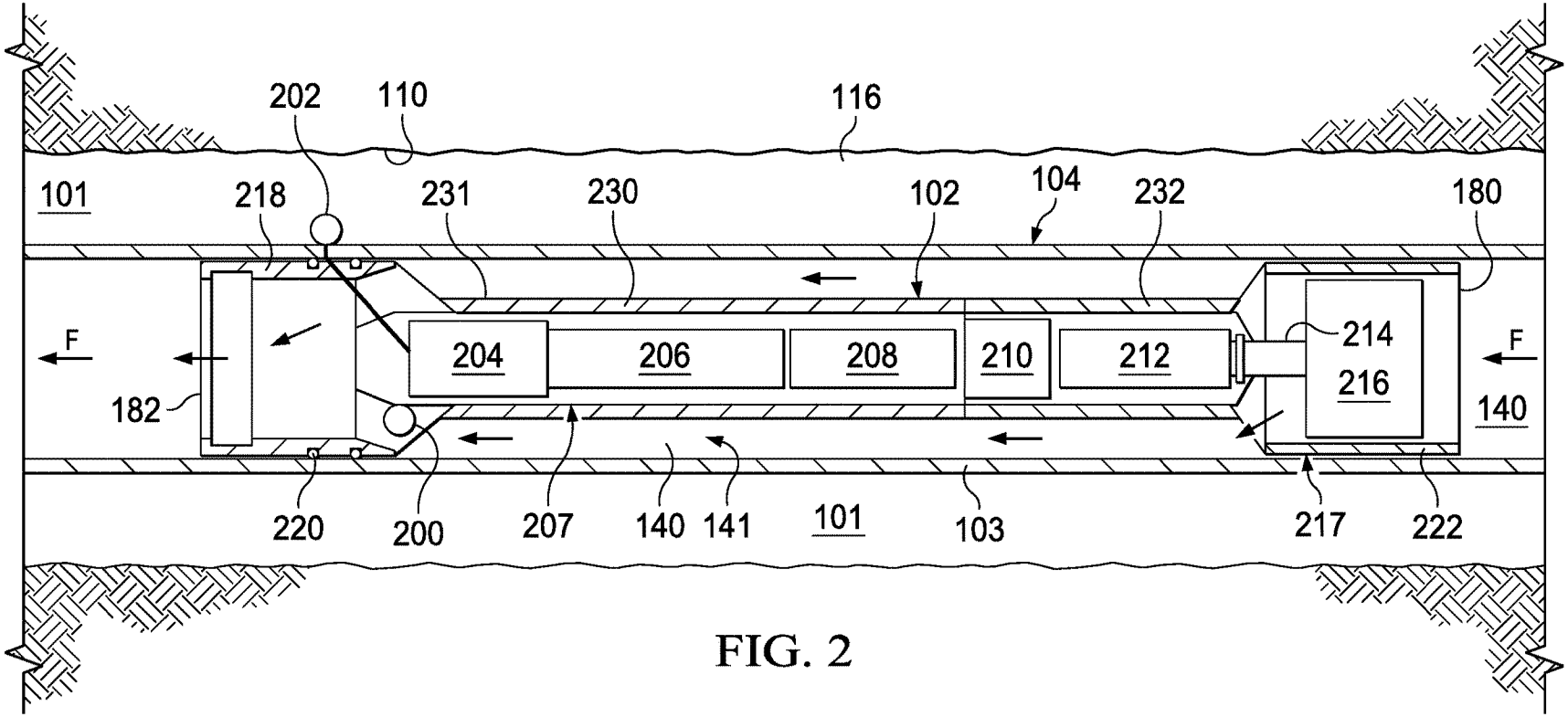
FIG. 2 is a side schematic view of an assessment assembly disposed inside a zonal isolation assembly.

Referring to FIG. 2, the assessment assembly 102 includes a first pressure sensor 200 that resides at the internal volume 140 of the isolation tubing 103. The first pressure sensor 200 senses a first pressure value representing a fluidic pressure of the internal volume 140. The assessment assembly 102 also includes a second pressure sensor 202 that resides at the isolated annulus 101 and senses a second pressure value representing a fluidic pressure at the isolated annulus 101.

The fluidic pressures at the internal volume 140 and at the annulus 101 are continuously or generality continuously sent to the receiver 106. For example, the pressure information from each pressure sensor can be sent to the receiver 106 in real-time or near-real time. By "real time," it is meant that a duration between receiving an input and processing the input to provide an output can be minimal, for example, in the order of seconds, milliseconds, microseconds, or nanoseconds, sufficiently fast to detect pressure communication at an early stage.

The fluidic pressure at the internal volume 140 and at the annulus 101 is sensed before production and during production. Specifically, the pressure values are gathered during drawdown. The drawdown pressure represents a change in pressure at the internal volume 140 as the wellbore 110 enters a flowing condition. During drawdown and during production, production fluid 'F' flows through the isolation tubing 103 and through a fluid pathway of the assessment assembly 102. The assessment assembly 102 defines a fluid pathway that extends from the inlet 180 of the assessment assembly 102 to the outlet 182 of the assessment assembly 102. The fluid pathway includes an annulus 141 in which the production fluid 'F' forms a tubular-shaped column around a tubular body 231 of the assessment assembly 102. The fluid pathway receives production fluid 'F' from the isolation tubing 104 at the internal volume 140 and flows the production fluid 'F' to the first pressure sensor 200 that is disposed along the fluid pathway. The second pressure sensor 202 is disposed away from the fluid pathway, outside the assessment assembly 102.

As shown in FIG. 2, the assessment tool 102 has a first housing 230 that protects circuitry 207 that includes a battery system 206 that powers electric components of the circuitry 207. The circuitry 207 also includes a pressure sensor system 204 and a controller and memory system 208. The pressure sensor system 204 receives a first pressure value from the first pressure sensor 200 and a second pressure value from the second pressure sensor 202. The circuitry transmits the first pressure value and the second pressure value to the receiver at the surface of the wellbore.

The assessment tool 102 also includes a second housing 232 coupled to the first housing 230. The second housing 232 protects at least a portion of an electric turbine assembly 217 and a pressure compensator 210. The electric turbine assembly 217 converts the kinetic energy of the production fluid into electricity, similar to a hydroelectric power plant. The electric turbine assembly 217 includes a turbine 216 axially coupled to a rotating shaft 214. The turbine 216 rotates under fluidic pressure of the production fluid 'F' flowing through the turbine 216. The turbine 216 rotates the shaft 214 that is coupled to an electric generator 212 that produces electricity through rotation of the shaft 214. The electric generator 212 is electrically coupled to and configured to charge batteries of the battery system 206. Thus, the assessment assembly 102 is an autonomous assessment assembly that uses a harvesting system (the electric turbine assembly 217) configured to harvest energy from the production fluid 'F' to power electronics electrically coupled to the first and second pressure sensor.

The pressure sensor system 204 of the assessment tool 102 can do some processing of the pressure values, such as averaging, determining a minimum and maximum value, and computing standard deviations. The memory system 208 can store the pressure data from the sensors and the pressure sensor system 204 can measure, pack, and transmit the sensor data to the processor 107 at the surface of the wellbore (see FIG. 1). The surface processor 107 can have more computational power than the pressure sensor system 204 and can run prediction models by comparing large quantitative datasets and using designed algorithms. The surface processor 107 can further transmit data to a remote secure server or end user dashboard. The surface processor 107 can also facilitate threshold monitoring and can trigger alarms. The electric generator 212 can power the battery system 206 and power the sensor system 204, the pressure sensors 200 and 202, and the wireless communications system of the sensor system 204.

The assessment assembly 102 has a turbine housing 222 that includes a guide vane for the turbine 216. The assessment assembly also includes a sensor hub 218 opposite the turbine housing 222. As further described in detail below with respect to FIG. 4, the sensor hub 218 is attached to an engagement assembly that receives and engages with a retrieving tool to retrieve the assessment assembly 102. The first housing 230 and the second housing 232 are attached to and disposed between the sensor hub 218 and the turbine housing 222. The first housing 230 and the second housing 232 together form a tubular body 231 that is attached to the turbine housing 222 and to the sensor hub 218. The turbine housing 222 is movable along the longitudinal axis of the isolation tubing 103 and the sensor hub 218 is fixed to the inner wall of the isolation tubing. The sensor hub 218 can be releasably attached to the inner wall of the isolation tubing 103 (for example, with shear pins) to allow the assessment assembly 102 to be retrieved. The sensor hub can include sealing rings 220 (for example, O-rings) to isolate the pressure sensing ports of the second pressure sensor 202 from the inside of the isolation tubing 103.

Figure 3:
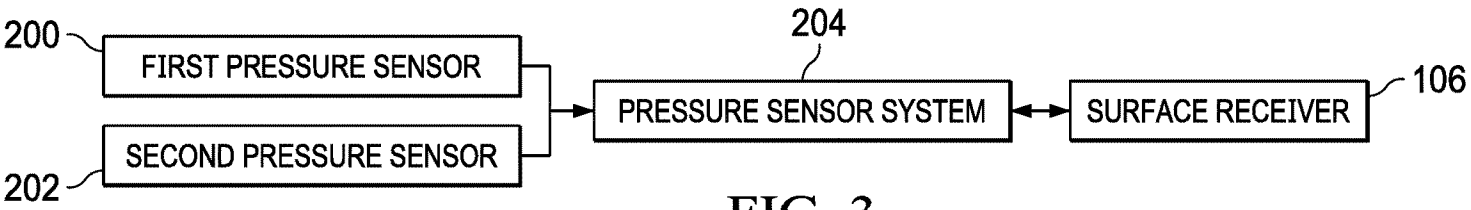
FIG. 3 is a block diagram of an example assessment system.

FIG. 3 shows a block diagram of a zonal isolation assessment system. The system includes the first sensor 200 and second sensor 202 in communication with the pressure sensor system 204. The first sensor 200 and the second sensor 202 transmit the sensed pressure data to the pressure sensor system 204, which can include a processor that processes the pressure data. The pressure sensor system 204 transmits the pressure information to the surface receiver 106 which can include a user interface that indicates the isolation integrity of the isolated zone. The pressure sensor system 204 can continuously or generally continuously transmit real-time data to the receiver 106. The real-time data can represent a first set of pressure values sensed by the first pressure sensor 200 over time before and during production and a second set of pressure values sensed by the second pressure sensor 202 over time before and during production.

The first and second set of pressure values are usable to determine the zonal isolation integrity. For example, the pressure sensor system 204 or the processor 107 at the surface determines a difference between the first pressure value and the second pressure value and determines, based on comparing that difference to a user defined threshold, the zonal isolation integrity of the zonal isolation assembly. Specifically, the first set of pressure values are compared to the second set of pressure values to determine a rate of change between the first set of pressure values and the second set of pressure values.

For a zone to have good zonal isolation integrity (for a good seal), during drawdown of the wellbore, the second set of pressure values (the pressure at the annulus 101) should remain constant, and not be affected by the drawdown pressure of the wellbore (the change in pressure of the first set of pressure values). Over time, the second set of pressure values in the isolated zone can decrease slightly as water in the reservoir shifts inside the reservoir, causing small pressure changes. The time period from when the annulus pressure (the second set of pressure values) start to change, to when the values become stabile may imply which type of leakage is happening. For example, if the annulus pressure rapidly equalizes to the tubular pressure (the pressure inside the tubing 103) after drawdown, there is a high continuous leakage rate between the isolated annulus 101 and the tubing 103 (and by extension, the production zone). If the annulus pressure stabilizes at 50% of drawdown pressure change, and this occurs after several hours or even days, there may be production of water from the outside of the isolated zone. In such cases, the length of the isolated zone needs to be increased.

The rate of change is compared to a threshold that represents a percentage of a drawdown pressure change. The drawdown pressure change is, for example, 300 Psi when the no production pressure is 3500 Psi in the tubing 103 and the production pressure in the tubing 103 is 3200 Psi. Thus, the user-defined threshold can represent 5% of the drawdown pressure change, and the isolation integrity is determined to be compromised when the rate of change over time is equal to or larger than the threshold, and normal isolation integrity is determined when the rate of change over time is less than the threshold. In some implementations, only the pressure values from the second sensor can be used to determine zonal isolation integrity. For example, the rate of change of the second pressure value from the time the first pressure value detects the drawdown pressure can be used to detect zonal isolation integrity. Thus, the rate of change of the second set of pressure values can be used from a point in time at the beginning of a drawdown pressure.

In some implementations, the threshold can be a value that represents a difference between the first set of pressure values and the second set of pressure values, or a value that represents a rate of change between the first set of values and the second set of values. For example, another way of quantifying the isolation integrity is by using a leak rate percentage (for example, leakage percentage). In this percentage range, 100% can represent a full opening between the isolated zone and the tubular section, indicating full fluid communication. Conversely, 0% can indicate no fluid communication, and that the isolated zone has full sealing integrity. Thus, the monitoring or assessment system 100 includes continuous monitoring, and can also monitor trends over time. The system 100 can monitor the entire isolated zone 'I' of the wellbore 110, and can permanently monitor isolated zones in the open hole section of the wellbore 110.

Figure 4:
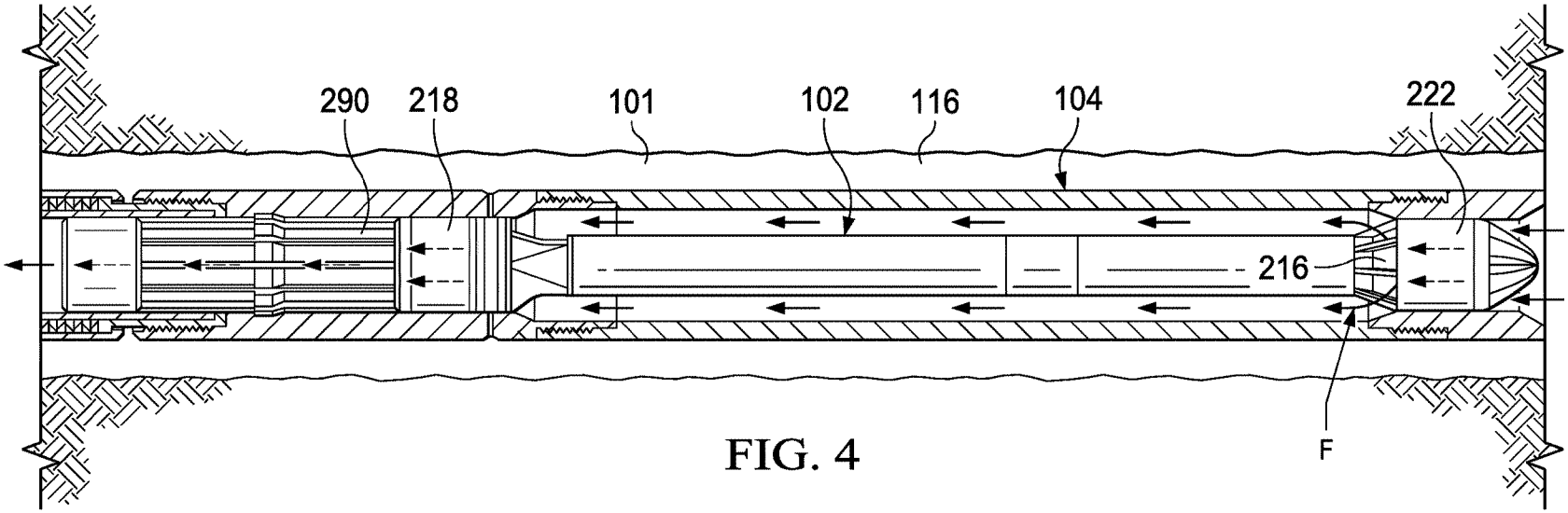
FIG. 4 is a side, partially cross-sectional view of the assessment assembly.

FIG. 4 shows a side view of the assessment assembly 102 with the sensor hub 218 attached to an engagement assembly or snap latch 290. The snap latch 290 can be releasably coupled to the isolation tubing 103. A retrieving tool can be used to retrieve the assessment assembly 102 from the wellbore 110. The retrieving tool has a matching profile with the internal dimensions of the snap latch 290, so that when the retrieving tool is connected, a jarring mechanism on the tool string can transmit impact force to the assessment assembly 102 to disconnect the assessment assembly from the isolation tubing 103.

Figure 5:
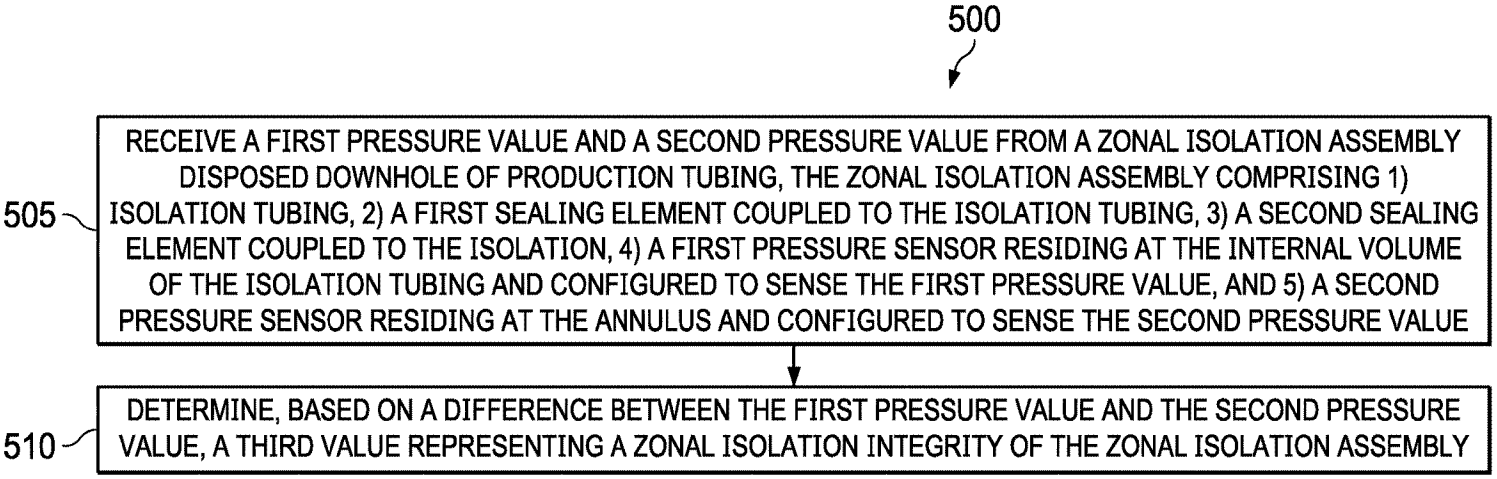
FIG. 5 is a flow diagram of an example method of determining the isolation integrity of an isolated zone in a wellbore.

FIG. 5 shows a flow diagram of an example method 500 of determining an isolation integrity of an isolated zone in a wellbore. The method 500 includes receiving, by a receiver at or near a surface of a wellbore, a first pressure value and a second pressure value from a zonal isolation assembly disposed downhole of production tubing, the zonal isolation assembly comprising 1) isolation tubing, 2) a first sealing element coupled to the isolation tubing, 3) a second sealing element coupled to the isolation tubing and disposed downhole of the first sealing element, 4) a first pressure sensor residing at the internal volume of the isolation tubing and configured to sense the first pressure value, and 5) a second pressure sensor residing at the annulus and configured to sense the second pressure value (505). The method also includes determining, based on a difference between the first pressure value and the second pressure value, a third value representing a zonal isolation integrity of the zonal isolation assembly (510).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A zonal isolation assessment system comprising:

a receiver comprising a processor and residing at or near a surface of a wellbore;

production tubing configured to be disposed in the wellbore;

a zonal isolation assembly configured to reside downhole of and fluidically coupled to the production tubing, the zonal isolation assembly configured to isolate a zone of the wellbore and comprising:

isolation tubing configured to flow production fluid from the wellbore to the production tubing, a first sealing element coupled to the isolation tubing, and a second sealing element coupled to the isolation tubing and disposed downhole of the first sealing element, the first sealing element and the second sealing element configured to be set on a wall of the wellbore to fluidically isolate an internal volume of the isolation tubing from an isolated annulus defined between the isolation tubing and the wall of the wellbore, the annulus extending from the first sealing element to the second sealing element; and an assessment assembly disposed at least partially inside the isolation tubing and communicatively coupled to the receiver, the assessment assembly comprising, a first pressure sensor residing at the internal volume of the isolation tubing and configured to sense and transmit, to the receiver, first pressure information comprising a fluidic pressure of the internal volume over a period of time, and a second pressure sensor residing at the annulus and configured to sense and transmit, to the receiver, second pressure information comprising a fluidic pressure of the annulus over a period of time, the processor configured to determine, based on the first pressure information and the second pressure information, a change in pressure over time of the internal volume and a change of pressure over time of the annulus and the processor configured to determine, based on a determined relationship between the change in pressure over time of the internal volume and the change of pressure over time of the annulus, a value representing a level of zonal isolation integrity of the zonal isolation assembly, the value being between and including a no loss value and a full loss value.

2. The system of claim 1, wherein the first pressure information comprises a first set of pressure values sensed by the first pressure sensor over time before and during production, and wherein the second pressure information comprises a second set of pressure values sensed by the second pressure sensor over time before and during production, wherein the value representing the level of zonal isolation integrity comprises a leak rate, and the leak rate comprises a quotient between the change of pressure over time of the internal volume and the change of pressure over time of the annulus.

3. The system of claim 2, wherein the processor is configured to compare the leak rate to a leak rate threshold, the leak rate threshold representing represents a percentage of a drawdown pressure that represents a change in pressure at the internal volume as the wellbore enters a flowing condition, the processor configured to transmit information to trigger, based on a determination that the leak rate satisfies the leak rate threshold, an alarm.

4. The system of claim 3, wherein the leak rate threshold is 5% or less of the drawdown pressure, and the processor is configured to determine that the leak rate satisfies the leak rate threshold when the leak rate is equal to or greater than the leak rate threshold.

5. The system of claim 1, wherein the assessment assembly is configured to continuously or generally continuously transmit real-time data to the receiver, the real-time data representing a first set of pressure values sensed by the first pressure sensor over time before and during production and a second set of pressure values sensed by the second pressure sensor over time before and during production, the first and second sets of pressure values usable to determine the value representing the level of zonal isolation integrity in or near real-time.

6. The system of claim 1, wherein the zonal isolation assembly is configured to be permanently set on the wall of the wellbore to isolate the zone of the wellbore during production.

7. The system of claim 1, wherein the wellbore is a non-vertical wellbore and the isolation tubing is disposed at a horizontal and open hole section of the wellbore and detached and spaced from the production tubing, the isolated zone comprising a region of the open hole section isolated by the first sealing element and the second sealing element set on a wall of the open hole section of the wellbore.

8. The system of claim 1, wherein the first sensor is attached to a bore of the isolation tubing and the second pressure sensor is attached to an outer surface of the isolation tubing.

9. The system of claim 1, wherein the assessment assembly is releasably coupled to and disposed inside the isolation tubing, and wherein the assessment assembly comprises a fluid pathway configured to receive production fluid from the isolation tubing at the internal volume and flow the production fluid to the first pressure sensor disposed along the fluid pathway.

10. The system of claim 9, wherein the assessment assembly is configured to be removed and retrieved from the isolation tubing by a retrieving tool run on wireline, slick line, or coiled tubing while the isolation tubing remains set on the wellbore.

11. The system of claim 9, wherein the assessment assembly comprises a first housing configured to house and protect circuitry and configured to house and protect a battery system configured to power electric components of the circuitry, the circuitry configured to receive the first pressure value and the second pressure value and configured to transmit the first pressure value and the second pressure value to the receiver.

12. The system of claim 11, wherein the assessment assembly comprises a second housing configured to house and protect at least a portion of an electric turbine assembly and a pressure compensator, the electric turbine assembly comprising a turbine axially coupled to a rotating shaft and configured to rotate under fluidic pressure of production fluid flowing through the turbine, the rotating shaft coupled to an electric generator configured to produce electricity through rotation of the shaft, the electric generator electrically coupled to and configured to charge batteries of the battery system.

13. The system of claim 12, wherein the assessment assembly comprises a turbine housing and an engagement end of the assessment assembly releasably attached to the isolation tubing, the first housing and the second housing forming a tubular body attached to and disposed between the turbine housing and the engagement end, the tubular body forming an annulus with a wall of the isolation tubing in which at least a portion of the fluid pathway is defined.

14. An assessment assembly comprising:

a receiver communicatively coupled to a processor and residing at or near a surface of the wellbore;

isolation tubing configured to be disposed in a wellbore downhole of production tubing, the isolation tubing configured to flow production fluid from the wellbore to the production tubing, a first sealing element coupled to the isolation tubing, a second sealing element coupled to the isolation tubing and disposed downhole of the first sealing element, the first sealing element and the second sealing element configured to be set on a wall of the wellbore to fluidically isolate an internal volume of the isolation tubing from an isolated annulus defined between the isolation tubing and the wall of the wellbore, the isolated annulus extending from the first sealing element to the second sealing element, a first pressure sensor residing at the internal volume of the isolation tubing, the first pressure sensor communicatively coupled and configured to transmit first pressure information to a receiver at or near a surface of the wellbore, the first pressure information comprising a fluidic pressure of the internal volume over a period of time, and a second pressure sensor residing at the annulus, the second pressure sensor communicatively coupled and configured to transmit second pressure information to the receiver, the second pressure information comprising a fluidic pressure of the annulus over a period of time, the processor configured to determine, based on the first pressure information and the second pressure information, a change in pressure over time of the internal volume and a change of pressure over time of the annulus and the processor configured to determine, based on a determined relationship between the change in pressure over time of the internal volume and the change of pressure over time of the annulus, a value representing a level of zonal isolation integrity of the zonal isolation assembly, the value being between and including a no loss value and a full loss value.

15. The assessment assembly of claim 14, wherein the first pressure sensor and the second pressure sensor are coupled to an autonomous assessment assembly releasably coupled to the isolation tubing, the autonomous assessment assembly comprising a turbine assembly configured to harvest energy from the production fluid to power electronics electrically coupled to the first and second pressure sensor.

16. The assessment assembly of claim 14, wherein the assessment assembly is configured to continuously or generally continuously transmit real-time data to the receiver, the real-time data representing a first set of pressure values sensed by the first pressure sensor over time before and during production and a second set of pressure values sensed by the second pressure sensor over time before and during production, the first and second sets of pressure values usable to determine the value representing the level of zonal isolation integrity.

17. The assessment assembly of claim 14, wherein the isolation tubing is configured to be permanently set on the wall of the wellbore to permanently isolate a zone of the wellbore during production.

18. The assessment assembly of claim 17, wherein the isolation tubing is disposed at an open hole section of the wellbore, the isolated annulus comprising a region of the open hole section and isolated by the first sealing element and the second sealing element set on a wall of the open hole section of the wellbore.

19. A method comprising:

receiving, by a receiver at or near a surface of a wellbore, first pressure information and second pressure information from a zonal isolation assembly disposed downhole of production tubing, the zonal isolation assembly comprising 1) isolation tubing, 2) a first sealing element coupled to the isolation tubing, 3) a second sealing element coupled to the isolation tubing and disposed downhole of the first sealing element, the first sealing element and the second sealing element configured to be set on a wall of the wellbore to fluidically isolate an internal volume of the isolation tubing from an isolated annulus defined between the isolation tubing and the wall of the wellbore, 4) a first pressure sensor residing at the internal volume of the isolation tubing and configured to sense the first pressure information, and 5) a second pressure sensor residing at the annulus and configured to sense the second pressure information, the first pressure information comprising a fluidic pressure of the internal volume over a period of time, and the second pressure information comprising a fluidic pressure of the annulus over a period of time;

determining, based on the first pressure information and the second pressure information, a change in pressure over time of the internal volume and a change of pressure over time of the annulus; and determining, based on a determined relationship between the change in pressure over time of the internal volume and the change of pressure over time of the annulus, a value representing a level of zonal isolation integrity of the zonal isolation assembly, the value being between and including a no loss value and a full loss value.

20. The method of claim 19, wherein receiving the first information comprises receiving a first set of pressure values sensed by the first pressure sensor over time before and during production, and wherein receiving the second information comprises receiving a second set of pressure values sensed by the second pressure sensor over time before and during production, and wherein determining the value representing the level of zonal isolation integrity comprises determining a leak rate, and the leak rate comprises a quotient between the change of pressure over time of the internal volume and the change of pressure over time of the annulus.

* * * * *